US005862603A

United States Patent [19]

Ellig

[11] Patent Number: 5,862,603

[45] Date of Patent: Jan. 26, 1999

[54] SIGHTING INDICIA

[76] Inventor: Michael Ellig, 1332 Bluebird La., Bozeman, Gallatin County, Mont. 59715

[21] Appl. No.: 891,716

[22] Filed: Jul. 11, 1997

[51] Int. Cl.[6] ..... F41G 1/467

[52] U.S. Cl. ..... 33/265; 124/87

[58] Field of Search ..... 33/265; 124/87

[56] References Cited

U.S. PATENT DOCUMENTS

| | | | |
|---|---|---|---|
| 802,277 | 10/1905 | Frice . | |
| 3,120,222 | 2/1964 | Bear | 33/265 |
| 3,184,851 | 5/1965 | Simmons . | |
| 3,568,323 | 3/1971 | Lendway . | |
| 3,579,839 | 5/1971 | Kowalski . | |
| 3,822,479 | 7/1974 | Kowalski . | |
| 3,945,127 | 3/1976 | Spencer . | |
| 4,070,763 | 1/1978 | Carts, Jr. . | |
| 4,166,324 | 9/1979 | Carollo et al. . | |
| 4,170,071 | 10/1979 | Mann et al. . | |
| 4,177,572 | 12/1979 | Hindes . | |
| 4,220,983 | 9/1980 | Schroeder . | |
| 4,309,827 | 1/1982 | Larson . | |
| 4,325,190 | 4/1982 | Duerst . | |
| 4,400,887 | 8/1983 | Mason . | |
| 4,495,705 | 1/1985 | Kowalski et al. . | |
| 4,813,150 | 3/1989 | Colvin | 33/265 |
| 4,819,611 | 4/1989 | Sappington . | |
| 4,928,394 | 5/1990 | Sherman . | |
| 4,977,677 | 12/1990 | Troescher, Jr. . | |
| 5,001,837 | 3/1991 | Bray . | |
| 5,094,002 | 3/1992 | Saunders . | |
| 5,121,462 | 6/1992 | Fabre et al. . | |
| 5,122,932 | 6/1992 | Ziller . | |
| 5,168,540 | 12/1992 | Winn et al. . | |
| 5,168,631 | 12/1992 | Sherman . | |
| 5,201,124 | 4/1993 | Sherman . | |
| 5,231,765 | 8/1993 | Sherman . | |
| 5,435,068 | 7/1995 | Thames et al. . | |
| 5,442,861 | 8/1995 | Lorocco . | |
| 5,619,801 | 4/1997 | Slates | 33/265 |
| 5,649,526 | 7/1997 | Ellig . | |
| 5,685,081 | 11/1997 | Winegar | 33/265 |

OTHER PUBLICATIONS

Bow Hunting World, Jun. 1997, cover, pp. 30–31, 42, 45, 49, and 78.

Golden Key–Futura Archery Catalog No. 3, cover and p. 10, 1995.

*Primary Examiner*—G. Bradley Bennett

[57] ABSTRACT

A sighting system utilizes identical sight pins to form a series of sighting indicia for aiming a bow. The sight pins comprise a contrast fin with a sighting end surrounding an aiming dot of a light gathering member which is held by a transparent flange connected to the contrast fin. The transparent flange allows almost the entire surface area of the light gathering member to be used to gather light which is focused at an end of the light gathering member which forms the aiming dot. In an alternate embodiment the sight pin is formed of a unitary piece entirely of contrast material. In another embodiment of the sight pin, a shaft is provided with a threaded outer surface and a channel through the outer surface for receiving the light gathering member. The sight end of the sight pin is coated to form a contrast between the aiming dot and the sight pin.

22 Claims, 2 Drawing Sheets

SIGHTING INDICIA

BACKGROUND OF THE INVENTION

This invention relates to sighting indicia for aiming an arrow to be fired from a bow and, more particularly, to illuminated sight pins maximizing the light gathering capabilities of light gathering members while sufficiently supporting the light gathering members.

In firing an arrow from a bow, a skilled archer performs a regimented sequence of steps to obtain high accuracy. The archer will always nock the arrow (snap the arrow on the bow string) at the same point, and the archer will always draw the string back the exact same distance. The latter is accomplished by drawing the string back until a particular portion of the hand contacts a particular portion of the head or by means attached to the string which stop the draw at the desired point. Thus, the feathered end of the arrow is always at a fixed distance from the eye. The archer then aligns the arrow laterally with a target. This leaves only the action of elevating or lowering the arrow head to correspond to the distance to the target. While in the past archers have determined the arrow head elevation by intuition, it has become common for archers to utilize a sighting system with sighting indicia such as sight pins to aid in aiming the arrow. To protect the sighting indicia from breakage and prevent them from being bumped out of place, sighting systems frequently incorporate a guard which partially surrounds the sighting indicia.

When hunting, one of the best times of day to find game is during the dimly lighted, early morning or late evening hours. During such periods, visibility of the sighting indicia is impaired or non-existent. Accordingly, lighted sights have been devised in an attempt to overcome this problem, and recently, devices, such as those disclosed in U.S. Pat. Nos. 4,928,394; 5,231,765; and 5,201,124 all to Sherman and 5,442,861 to Lorocco, have been developed with light gathering characteristics which are capable of focusing light gathered from the surroundings at a small point referred to herein as an aiming dot. The light gathering members of these devices are lightweight but brittle and thus easily broken.

The archer's ability to identify the aiming dot is improved by increasing the brightness of the aiming dot. The aiming dot depends directly on the surface area of the device light gathering member which is, available to gather light. However, the size and configuration of the device must be limited to prevent obstruction of the archer's vision. The archer's ability to identify the aiming dot is further enhanced by utilizing a sight pin which sufficiently contrasts the aiming dot. The '394 and '765 Sherman references and the '861 Lorocco reference disclose sighting systems which utilize sight pins with each sight pin having a relatively long, small diameter light gathering fiber for gathering light and directing it to the aiming dot which is located at one end of the sight pin. The sight pin of the '124 Sherman reference utilizes a molded plastic with a fluorescent dye dispensed therein. The sight pins of these references provide a well illuminated aiming dot.

With regard to the Sherman references, however, the fibers loop around the sighting system in a complex fashion increasing cost and leaving portions of the fibers unsupported and thus susceptible to breakage. Further, the bodies of the fibers are visible to the archer and the aiming dots are not well contrasted, for example, by a surrounding black surface. These factors reduce the archer's ability to identify and concentrate on the aiming dots. The '124 Sherman reference addresses the breakage problem and reduces the sight pin configuration complexity by providing a shorter, relatively larger diameter light gathering members made of molded plastic, which taper toward the aiming dots. While the larger diameter members provide sufficient surface area for gathering light, they are brittle and unsupported or unprotected. Further, the aiming dot is insufficiently contrasted. The '861 Lorocco reference, suffers from similar deficiencies. The body of the fiber is visible to the archer, and the aiming dot is not contrasted. Further, the fiber is insufficiently protected to prevent breakage especially at the most susceptible point, the aiming dot.

To provide sufficient contrast, one commercially available sighting system utilizes a black sight pin which holds the light gathering fiber. Sufficient surface area is provided for gathering light by looping the light gathering fiber out away from the sight pin in a plane parallel to the archer's line of sight and behind the sight pin. In this manner, the light gathering surface area is increased without additional obstruction of the archer's vision, and the black sight pin masks the body of the light gathering fiber from the archer's vision and surrounds the aiming dot to sufficiently contrast the aiming dot. However, a portion of the light gathering fiber is separated from and extends beyond the protective structure of the sight pin and guard. Because the light gathering fiber is made from brittle materials, the small diameter fiber is easily broken, especially during hunting excursions through wooded areas and undergrowth where the unprotected fiber can be caught on tree branches and twigs and bumped against tree trunks or other obstacles. Clearly, an archer does not want to be replacing a sight pin when a rare and fleeting opportunity for a shot at wild game presents itself.

Another commercially available sight pin includes a light gathering fiber extending through a long and shiny tubular sight end with a clear plastic casing molded onto the sight end. The casing is threaded externally for mounting to an archery sighting system. Because the tubular sight end is shiny and only slightly larger than the fiber, this sight pin fails to sufficiently contrast the aiming dot, and it also fails to minimize the potential distraction from the body of the light gathering fiber. Further, the tubular sight end does not allow light through thereby decreasing the intensity of the aiming dot.

Thus, providing an illuminated sighting indicia with a light gathering member which is not susceptible to breakage, has sufficient exposed surface area for gathering light, and which sufficiently contrasts the aiming dot is desirable to enhance the durability, reliability, and the natural light gathering function of sighting indicia.

BRIEF SUMMARY OF THE INVENTION

One embodiment of the invention is to provide a novel sight pin for use with a bow. The sight pin has a black contrast fin and a flange extending from the contrast fin. The flange has a receiving area to receive and hold an elongated light gathering member. One end of the light gathering member forms an aiming dot adjacent to the sight end of the contrast fin. The contrast fin masks the body of the light gathering member, so that the archer cannot see the light gathering member. The contrast tip is made of a stronger more durable material. Further, the contrast fin preferably surrounds the aiming dot. Therefore, the sight pin sufficiently contrasts the aiming dot. The receiving area of the flange in combination with the contrast fin support and thus protect the light gathering member from breakage over its entire length thereby increasing the durability and reliability of the sight pin. Thus, the light gathering member is not easily broken. Preferably, the flange is translucent to expose a maximum portion, nearly 100%, of the light gathering member surface area to ambient light thereby maximizing the light gathering capabilities.

In an alternate embodiment, the flange is also black. In this embodiment, the flange and fin are formed as one piece to simplify, and reduce the cost of, manufacturing the pin. To expose sufficient surface area of the light gathering member to surrounding light and support it over its length, a plurality of opposing pairs of tabs define the receiving area and hold the light gathering member therein.

In another embodiment, a sight pin comprises a unitary translucent shaft with a threaded outer surface. A shaft channel cut into the outer surface of the shaft holds the light gathering fiber. The aiming dot located at the distal end of the fiber is surrounded by an opaque sight end of the shaft. Preferably, a black coating is applied to the sight end, and the shaft channel opens in a direction opposite the aiming dot. Thus, the opaque sight end sufficiently contrasts the aiming dot and masks a portion of the body of the fiber adjacent to the aiming dot from the archer's vision and supports and protects the aiming dot line. Further, the length of the shaft partially masks the remainder of the fiber to further contrast the aiming dot.

Accordingly, it is an object of the present invention to provide an improved sight pin exposing a maximum portion of the surface area of a light gathering member to surrounding light sources.

It is a further object of the present invention to provide an improved sight pin sufficiently contrasting the aiming dot.

It is a still further object of the present invention to provide an improved sight pin better protecting a light gathering member from breakage.

BRIEF DESCRIPTION OF THE DRAWINGS

These and other features, advantages, and objects will appear from the following Detailed Description when considered in connection with the accompanying drawings in which similar reference characters denote similar elements throughout the several views and wherein.

DETAILED DESCRIPTION

Figure 2:
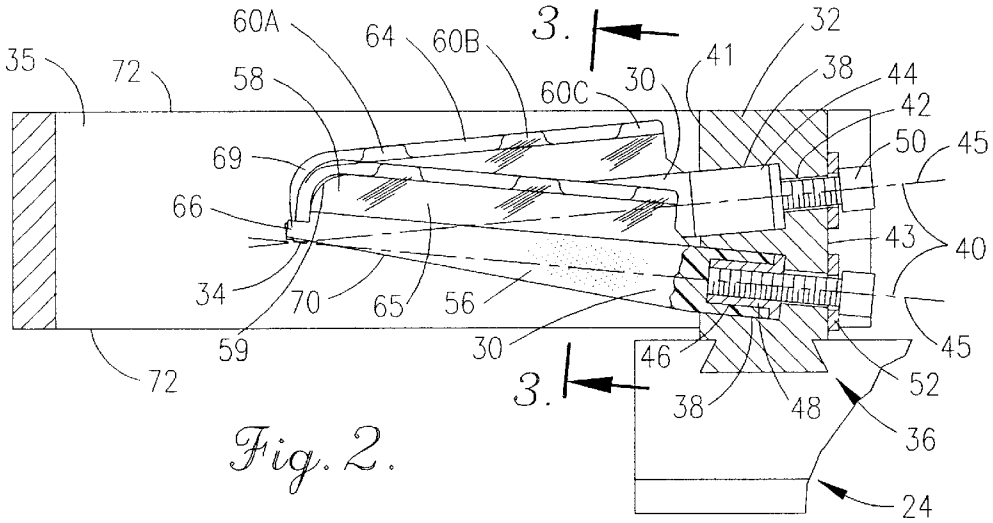
FIG. 2 is an enlarged cross-sectional view of the sighting system of FIG. 1 taken along line 2—2 of FIG. 1.
Figure 1:
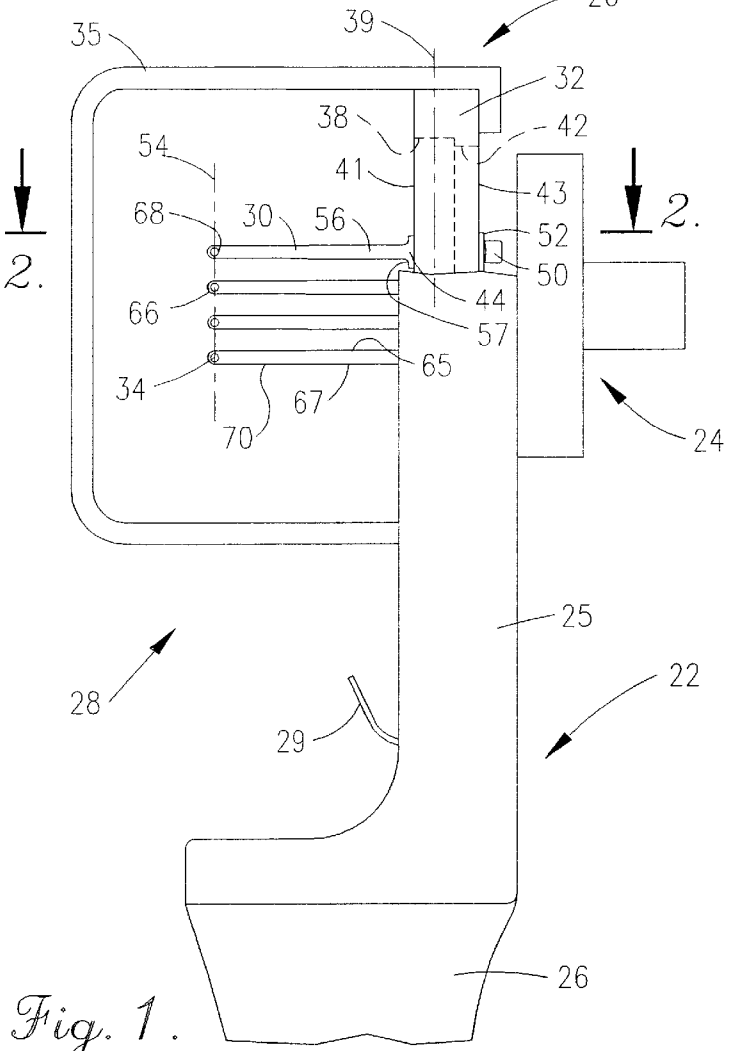
FIG. 1 is a fragmentary elevational view of a bow having a sighting system utilizing sight pins according to the present invention.

FIG. 1, shows a sighting system, generally designated 20, attached to a conventional bow, generally designated 22, with a mounting assembly, generally designated 24. Only relevant fragments of the bow are shown such as the riser 25, handle 26, and sighting area, generally designated 28, which is adjacent the riser 25. A conventional arrow rest 29 is located below the sighting area 28 and attached to the riser 25 to hold an arrow after it is loaded in the bow. The sighting system 20 holds a plurality of sight pins 30 in a pin mounting bracket 32. Each sight pin 30 has an aiming dot 34 at a distal end spaced away from the pin mounting bracket with the aiming dots being directed toward the archer's side of the sighting system. The archer's side, in contrast to the target side, is simply the side of the sighting system in the archer's line of sight. Each sight pin 30 has a light gathering member 64 which focuses gathered light at the aiming dot. In the preferred embodiment, a light gathering member 64 is held by transparent tabs 60 which extend from a transparent flange 58. The transparent flange and tabs maximize the light gathering capabilities of the light gathering member 64. Thus, the sight pins provide illuminated sighting indicia with each sight pin corresponding to a different range to a target. The sighting system also provides a rigid pin guard 35 which partially surrounds the sight pins 30. Referring additionally to FIG. 2, the pin guard is attached to the pin mounting bracket 32. As shown, the pin mounting bracket 32 is connected to the mounting assembly 24 by a conventional means for connection, such as a dove-tail connection assembly 36.

Pin mounting bracket 32 has adjacent channels 38 formed in a front/pin side 41 of the pin mounting bracket. The channels 38 have parallel longitudinal axes 39 substantially extending along a length of the pin mounting bracket. The channels also have axes 40 extending through the depth of the channels. The axes 40 are angled with respect to each other such that the axes 40 intersect at an angle of approximately 10° if extended outwardly therefrom. Longitudinal bores 42, which are narrower than the channels, extend from the channels co-extensive with the axes 40 to the back/bolt side 43 of the pin mounting bracket 32.

The sight pins 30 are held in the adjacent channels 38, in alternating fashion. Each sight pin 30 has a connection base 44 with a central bore 46 for receiving a threaded insert 48. The connection base 44 of each sight pin is inserted into one of the channels 38 and a hexagonal socket head cap bolt 50 is inserted through the corresponding bore 42 and threaded into the insert 48 to secure the pin to the pin mounting bracket 32. Preferably, a washer 52 is interposed between the head of the bolt 50 and the back of the pin mounting bracket 32. Thus, the connection base 44, insert 48, and bolt 50 provide a means for connecting the sight pin to the pin mounting bracket.

It can be seen from FIG. 2 that the axes 40 of the adjacent channels 38 of the pin mounting bracket 32 coincide with central axes 45 of the connection bases 44 when the pins are inserted into the channels. Each pin is configured so that its central axis 45 extends through its respective aiming dot. Thus, the axes 40, 45 of the adjacent channels and the connection bases pass through the aiming dots of the corresponding sight pins. In this manner, all sight pins can be manufactured identically, and the aiming dots 34 are aligned in a straight line 54 at an equal distance from the pin mounting bracket 32 and substantially parallel to the riser 25 (FIG. 1) of the bow. Further, with each of the aiming dots in a straight line, the axes 45 intersect at the center of the aiming dot. Therefore, there is no need to manufacture unique sight pins for each of the two adjacent channels 38.

Figure 3:
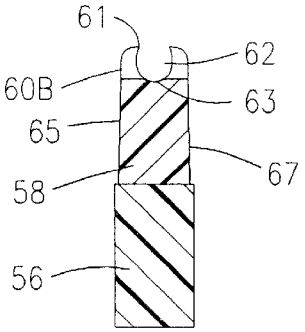
FIG. 3 is an enlarged cross-sectional view of the sight pin shown in FIG. 1 taken along line 3—3 of FIG. 2 and having a light gathering fiber removed for clarity.

Referring now to FIGS. 2 and 3, each sight pin 30 has an opaque contrast fin 56 extending from the connection base 44. The fin 56 is preferably black and non-shiny/ nonreflective. It may also be translucent with an opaque coating on the archer's side. The opaque coating would then comprise the contrast fin. The contrast fin 56 is thinner than the base 44 and extends from the middle of the base. The transition between the thicknesses of the fin 56 and base 44 is made gradual by concave arcs 57. The contrast fin has a necked down sight end 66 (FIG. 2) opposite the connection base 44 where the sight end 66 further defines a cylindrical aperture 68 therethrough. The aperture 68 has no bends or curves and thus has one single longitudinal axis. As the sight end 66 is notched or necked down at the outer end of fin 56, the aperture 68 is relatively shorter than the adjacent fin.

A preferably transparent and co-planar flange 58 extends from the target side of the contrast fin along at least a portion and preferably the entire length of the fin. Because the flange 58 and fin 56 are formed from different materials, the flange 58 is formed independently from the contrast fin 56 and attached thereto. The flange 58 is attached to the fin 56 by a means for connection such as an adhesive or mechanical connector including molding them together. The independent construction also allows the contrast fin to be made from a stronger material than the transport flange.

The flange 58 has a curved end 59 adjacent to the sight end 66 of fin 56 and also has three opposing pairs of tabs 60A, 60B, 60C opposite the contrast fin. These tabs are preferably transparent and form a light gathering member receiving area 62 (FIG. 3) therebetween. The first pair of tabs 60A is adjacent the sight end 66 of the contrast fin 56. The third pair of tabs 60C is adjacent the connection base 44, and the second pair of tabs 60C is between the first and third pairs and is closer to the third pair 60C and the connection base 44. Though the pairs of tabs are directly opposed, they could be staggered along the length of the flange or a single pair of continuous tabs could be provided along the length of the flange. As shown, the tabs comprise a relative small portion of the total length of the fin and are slightly taller than the width of the receiving area between the tabs. Specifically, the tabs of each face cover less than 40% of the length of the flange. The tips 61 of the tabs are curved slightly inward to snapably receive the light gathering member 64. In the alternating light gathering member 64 could be crimped or glued in place. The tabs of each pair extend from opposite faces 65, 67 of the flange 58 on the target side of the flange and, but for the tips 61, are substantially co-extensive therewith. Further, a shallow curved groove 63 is formed in the flange at the base of the receiving area to match the contour of the preferred light gathering member.

The light gathering member 64, preferably optic fiber or molded plastic in a rod-like shape, is inserted through the aperture 68 and snapped into the receiving area 62 where it is held in place by the tabs 60. Aperture 68 being relatively short permits a larger portion of the light gathering member's surface area to be exposed for the purpose of gathering light. Also the short length of the tabs covers a minimum of the surface area of the light gathering member. The light gathering member 64 has a bend 69, totalling approximately 90°, over the curved end 59 of the flange 58.

The cylindrical rod shape of the light gathering member 64 fits into the curved groove 63 (FIG. 3) in the flange 58. The distal end of the light gathering member protrudes from the archer's side of the cylindrical aperture 68 to form the aiming dot 34 of the sight pin 30. Thus, the sight end 66 surrounds the perimeter of the aiming dot. Because the contrast fin 56 and its sight end 66 are opaque (preferably black) the illuminated aiming dot is made more visible by its contrast with the contrast fin.

To further contrast the aiming dot, the archer's side surface 70 of the contrast fin is nearly in the same plane as the aiming dot. That is, the archer's side surface of the contrast fin is just behind the aiming dot. Still further, the opaque contrast fin 56 is interposed between the length of the light gathering member and the archer so as to substantially mask same from the archer's line of vision. Therefore, the contrast fin enhances the archer's ability to focus on the aiming dot while aiming the arrow.

As suggested above, each preferred light gathering member 64 is an elongated optical fiber which gathers light from surrounding ambient light sources. The member focuses the gathered light at the distal end having a lens which forms the aiming dot 34. As noted, the greater the portion of the surface area of the light gathering fiber which is exposed to surrounding light sources, the more light the member can gather and focus at the aiming dot thereby increasing the brightness of the aiming dot. This is significant because the brighter the aiming dot, the easier it is for the archer to identify and use it. Therefore, it is desirable to expose as much of the surface area of the light gathering member to surrounding light sources as possible. To further that goal, the flange 58 and tabs 60 protruding from the flange are formed with a translucent material to maximize the light transmitted therethrough.

Referring particularly to FIG. 2, each disclosed sight pin 30 exposes nearly 100% of the surface area of the light gathering member/rod 64 to surrounding light sources. Only the portion of the light gathering member passing through the aperture 68 of the sight end 66 is not exposed. Significantly, this is accomplished with the light gathering member supported and protected over its entire length by the sight pin. Further, the member 64 is held within the confines of the pin guard 35. That is, no portion of the member extends beyond the outer edges 72 of the pin guard, and this is accomplished without unduly widening the pin guard.

Figure 4:
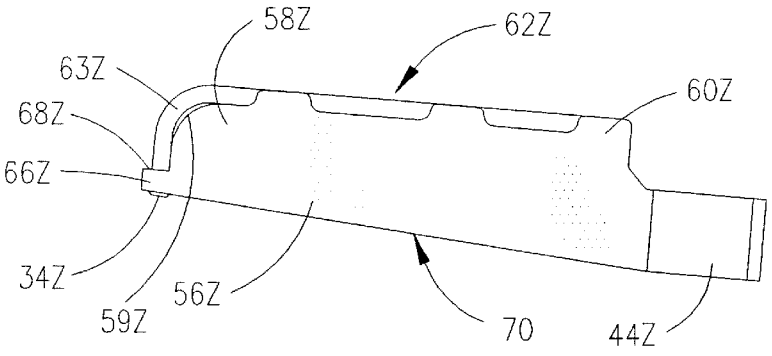
FIG. 4 is an enlarged side elevational view of an alternate embodiment of a sight pin.

In an alternate embodiment shown in FIG. 4 and in which similar features are designated by like reference numerals followed by the suffix Z, the sight pin 74 comprises a connection base 44Z, a contrast fin 56Z and a flange 58Z having opposing pairs of tabs 60Z forming a rod/member receiving area 62Z. In this embodiment, the flange 58Z and contrast fin 56Z are formed as a unitary piece from the black contrast materials. This embodiment sacrifices some of the light gathering capabilities of the light gathering member but is simplified in that it is less expensive to manufacture since the flange and contrast fin may be unitary in construction rather than separate pieces thereby eliminating the step of connecting the two pieces together. With the above described tabs 60Z and the short aperture 68Z, this embodiment still leaves a significant amount of the surface area of the light gathering member exposed for the purpose of gathering light.

Figure 5:
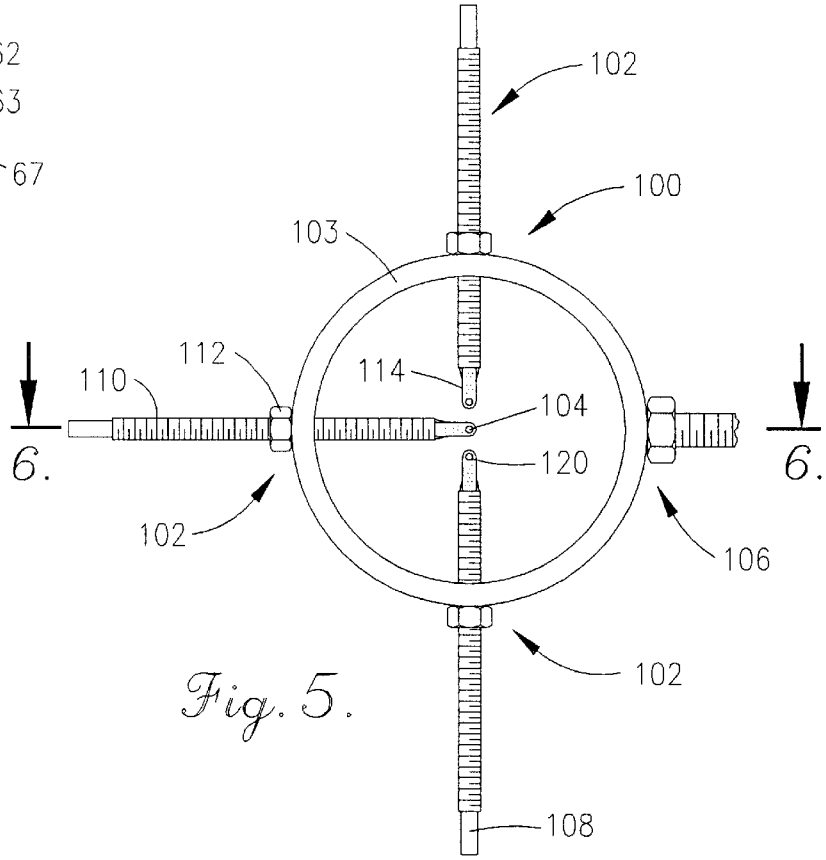
FIG. 5 is a fragmentary view of a sighting system having an alternate embodiment of a sight pin.
Figure 6:
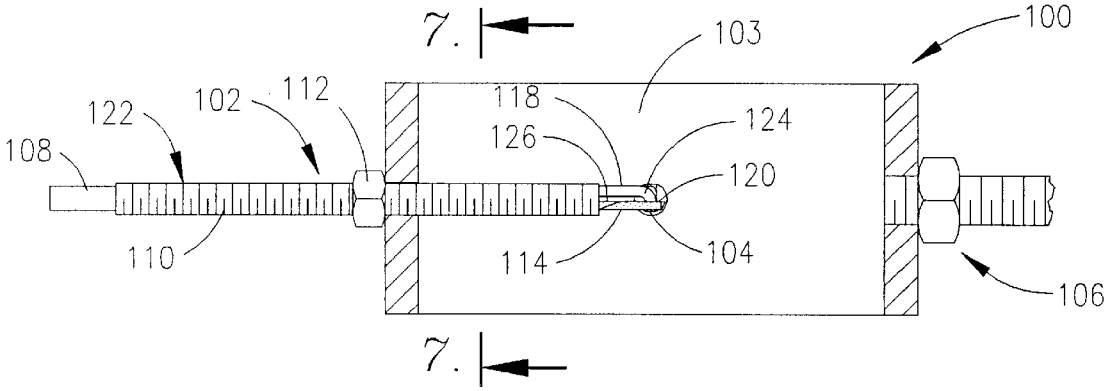
FIG. 6 is an enlarged cross-sectional view of the sighting system of FIG. 5 taken along line 6—6 of FIG. 5.
Figure 7:
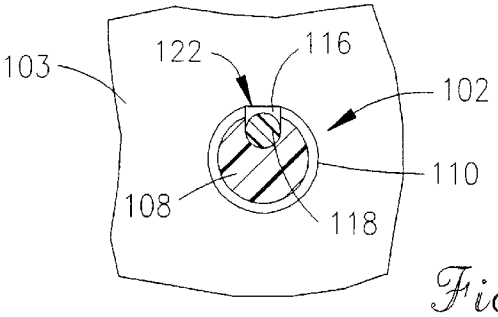
FIG. 7 is an enlarged fragmentary cross-sectional view of the sighting system of FIG. 5 taken along line 7—7 of FIG. 6.

Referring to FIGS. 5–7, an alternate sighting system, generally designated 100, utilizes a plurality of sight pins, generally designated 102, attached to a pin mounting bracket 103. Each sight pin 102 has an aiming dot 104 for targeting an arrow. The sighting system uses a conventional means for attachment 106 for connection to a bow (not shown).

Each sight pin 102 comprises a unitary shaft 108 having a threaded outer surface 110 for threadably engaging a nut 112 secured to the pin mounting bracket 103 which is the shape of a ring. A sight end 114 of the shaft 108 is opaque, but the remainder of the sight pin is translucent but may be transparent. Preferably, the sight end 114 is coated black. Though a ring shaped mounting bracket 103 is shown, the sight pins 102 can be threadably mounted in a bracket of the type shown in FIG. 1. The block coating is made by using an epoxy based ink. The ink is rolled or stamped onto the pin sight end 114. A pad printing machine is preferably used to imprint the pins.

A shallow channel 116 is formed into the shaft 108 and defines a light gathering member receiving area. The channel 116 is parallel to a longitudinal axis of the sight pin. The light gathering member 118, preferably a fiber or molded plastic in the shape of a cylindrical rod, extends through the channel and has the aiming dot 104 formed at one end. To correctly orient aiming dot 104, the member 118 has a substantially 90° bend 124 permitting the member to extend through a relatively short aperture 120 in the opaque sight end 114. Thus, the aiming dot 104 protrudes from the sight end and will be visibly apparent to the archer. The aperture has no bends or curves and thus has only a single longitudinal axis.

The channel has a linear longitudinal opening, generally designated 122, at the surface of the sight pin, with the aiming dot being pointed in a direction opposite the longitudinal opening 122. Because the longitudinal channel opens opposite the aiming dot, the shaft 108 shields the body of the light gathering member from the archer's vision though the member is still slightly visible through the translucent shaft. To increase the shielding result, the depth of the channel 116 is preferably less than the radius of the shaft 108. The shallowness of the channel maximizes the thickness of the shaft between the light gathering member and the archer thereby further diminishing the visibility of the light gathering member and helping to accentuate the aiming dot. The aiming dot 104 brightness is accentuated by the contrast between the aiming dot and the opaque sight end 114 since the opaque sight surrounds the perimeter of the aiming dot. The Opaque sight end 114 extends along the shaft 108 a distance approximately 10% of the total length of the shaft and completely shields the portion of the light gathering member behind it (adjacent the aiming dot), to further accentuate the aiming dot brightness. Because the opaque sight end 114 surrounds the perimeter of the aiming dot, it also supports and protects the aiming dot which is located at the weakest part of the pin, its tip.

Because the coated sight end 114 is only approximately 10% of the total length of the sight pin, combined with the fact that the shaft is translucent, the light gathering capability of the light gathering member is maximized. Further, since the aperture 120 through the sight end 114 is short and there is a gap 126 between the light gathering member 118 and the opaque sight end 114, nearly 100% of the light gathering member's surface area is exposed to surrounding light sources.

Thus, sight pin embodiments are disclosed which maximize the light gathering capabilities of a light gathering member when the sight pins are mounted on a bow while simultaneously protecting the light gathering member from breakage. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A sight pin for use with a bow having a pin mounting bracket, the sight pin comprising:

a contrast fin having a fin length and a sight end;

a flange extending from the contrast fin along at least a portion of the fin length, and having a light gathering member receiving area;

an elongated light gathering member extending through the receiving area and having an end forming an aiming dot adjacent the sight end of the contrast fin; and means, provided on the sight pin, for connecting the sight pin to the pin mounting bracket.

2. The sight pin according to claim 1 wherein the light gathering member comprises a cylindrical rod having a rod length, and the rod is supported by the flange over substantially all of the rod length.

3. The sight pin according to claim 1 wherein the sight end of the contrast fin comprises an aperture to receive the aiming dot, the light gathering member is supported over its entire length by the flange and contrast fin in combination, and the light gathering member having a substantially 90° bend therein.

4. The sight pin according to claim 1 wherein the flange comprises an archer's side attached to the contrast fin, a target side opposite the fin side, the target side defining the receiving area, and a rounded sight end adjacent the sight end of the contrast fin.

5. The sight pin according to claim 1 further comprising at least one pair of tabs extending from the flange and defining the receiving area, and wherein the contrast fin and flange comprise one unitary piece.

6. The sight pin according to claim 1 wherein the flange comprises a face having at least one tab extending from the face in a direction substantially parallel to the face, and second face having at least one tab extending from the second face in a direction substantially parallel to the second face, and the tabs defining the receiving area.

7. The sight pin according to claim 6 wherein the flange comprises a transparent flange and the tabs comprise transparent tabs.

8. The sight pin according to claim 1 wherein the contrast fin is opaque and the flange is translucent.

9. The sight pin according to claim 1 further comprising a connection base attached to the contrast fin, and the connection base comprises a central axis extending through the aiming dot.

10. A sight pin for use with a bow having a pin mounting bracket, the sight pin comprising:

an opaque contrast fin having a fin length and a sight end;

a translucent flange extending from the opaque fin along at least a portion of the fin length, and having a light gathering member receiving area;

an elongated light gathering member extending through and held in the receiving area and having an end forming an aiming dot adjacent the sight end of the opaque fin; and means, provided on the pin, for connecting the pin to the pin mounting bracket of the bow.

11. The sight pin according to claim 10 wherein the flange comprises at least one pair of opposing transparent tabs opposite the contrast fin and defining the member receiving area therebetween.

12. The sight pin according to claim 10 wherein the translucent flange comprises a plurality of spaced apart pairs of opposing tabs defining the member receiving area therebetween.

13. The sight pin according to claim 10 wherein the opaque fin comprises a black fin, the translucent flange comprises a transparent flange, the light gathering member comprises a fiber optic light gathering rod, and the black fin shields the light gathering rod from an archer's vision while aiming.

14. The sight pin according to claim 10 wherein the end of the member forming the aiming dot comprises a lens.

15. The sight pin according to claim 10 wherein the receiving area has a curved base, and the light gathering member snaps into the member receiving area.

16. A sight pin for use with a bow having a pin mounting bracket, the sight pin comprising:

a unitary and translucent shaft having a threaded outer surface, a rod receiving channel with a longitudinal opening defined in the outer surface, and an opaque sight end;

a light gathering rod extending through the channel and having an end forming an aiming dot adjacent the sight end of the shaft accentuating the aiming dot by contrast to the opaque sight end.

17. The sight pin according to claim 16 wherein the opaque sight end comprises a short aperture having a central axis extending in only one direction, the aiming dot protrudes from the aperture, and the aiming dot is surrounded about its perimeter by the opaque sight end.

18. The sight pin according to claim 16 wherein the aiming dot is directed opposite the longitudinal opening, the sight end is approximately 10% of a length of the shaft, and the opaque sight end extends along the shaft shielding a portion of the light gathering rod adjacent the aiming dot from the archer's vision while aiming.

19. The sight pin according to claim 16 wherein the channel comprises a depth less than a radius of the shaft.

20. An archery sighting system comprising:

a mounting assembly for attachment to a bow;

a pin mounting bracket;

means for connecting the pin mounting bracket to the mounting assembly;

a plurality of sight pins connected to the pin mounting bracket;

each sight pin including:

an opaque contrast fin having a fin length and a sight end;

a translucent flange extending from the contrast fin along at least a portion of the fin length, and having a rod receiving area;

an elongated light gathering member extending through and held in the member receiving area and having an end forming an aiming dot adjacent the sight end of the opaque contrast fin; and means for connecting the sight pin to the pin mounting bracket.

21. The sighting system according to claim 20 wherein the mounting bracket comprises adjacent channels for receiving the sight pins, at least one sight pin is placed in each channel, the pin connecting means comprises a central axis extending through the pin connecting means and through the aiming dot, and the sight pins are similarly configured with all of the aiming dots forming a straight line substantially parallel to a riser of the bow.

22. The sighting system according to claim 20 wherein the light gathering member comprises a substantially 90° bend therein.

* * * * *